United States Patent [19]

Linke et al.

[11] 4,445,878

[45] May 1, 1984

[54] CHAIN STRIPPER DEVICES AND ASSEMBLIES FOR MINING MACHINES

[75] Inventors: Horst Linke, Lunen; Josef Albers, Nordkirchen; Helmut Erwien, Lunen, all of Fed. Rep. of Germany

[73] Assignee: Gewerkschaft Eisenhutte Westfalia, Lunen, Fed. Rep. of Germany

[21] Appl. No.: 307,783

[22] Filed: Oct. 2, 1981

[30] Foreign Application Priority Data

Oct. 4, 1980 [DE] Fed. Rep. of Germany ..... 3037585

[51] Int. Cl.[3] ..... F16H 57/00

[52] U.S. Cl. ..... 474/92; 474/273; 198/497; 299/82

[58] Field of Search ..... 474/273, 92; 299/82, 299/83, 84; 175/313; 198/497, 735

[56] References Cited

U.S. PATENT DOCUMENTS 1,769,371 7/1930 Holdaway ..... 175/313

2,306,943 12/1942 Glase ..... 198/497

4,093,065 6/1978 Temme ..... 198/735

*Primary Examiner*—John E. Murtagh

*Assistant Examiner*—Andrew Joseph Rudy

*Attorney, Agent, or Firm*—Thompson, Birch, Gauthier & Samuels

[57] ABSTRACT

A machine frame for a scraper-chain conveyor employs a housing or 'plough box' containing a chain wheel for driving a haulage chain. A stripper device is provided in the housing to separate the chain from the chain wheel. The stripper device is composed of a one-piece shaped element with an arcuate blade projecting into the chain wheel. The element is fitted to a mounting flange of the housing with a single upstanding bolt-and-nut and a separate complementary locking member. The element, the locking member and the flange have shape-locking interengaging projections and recesses. The device can be positionally inverted.

12 Claims, 4 Drawing Figures

CHAIN STRIPPER DEVICES AND ASSEMBLIES FOR MINING MACHINES

BACKGROUND TO THE INVENTION

The present invention relates in general to assemblies for use with machine frames of scraper-chain conveyors and more particularly to assemblies and arrangements which employ chain stripper devices for separating a chain from a chain wheel or sprocket.

In underground mineral mining installations, it is known to employ a frame at one end of a scraper-chain conveyor which supports drive means driving the scraper-chain assembly as well as a chain used to haul a winning machine such as a plough along the mineral face. The machine drive chain is usually entrained around a chain or sprocket wheel disposed in a housing called a 'plough box' at one side of the frame. In order to ensure that the chain is separated from the chain wheel, it is known to use a stripper device which has a blade or tongue of arcuate shape which projects into the peripheral profile of the chain wheel. The stripper device is detachably mounted within the plough box. Similar stripper devices can also be employed to separate the scraper-chain assembly from its drive drum.

The plough box itself is quite narrow and this presents problems in fitting and dismantling the chain stripper device. It is known to use a two-part stripper device which is fitted to a horizontal wall in the plough box by means of bolts. An example of such an arrangement is described in U.S. Pat. No. 3,871,513 (Georg et. al) granted 18, Mar. 1975. Another problem encountered in these assemblies is that of compatability. Chain wheels of various sizes are used and the chain wheels are interchanged and replaced from time to time. Hence, stripper devices of corresponding dimensions need to be provided. It is also common to provide main and auxiliary drive stations for the conveyor and the plough box can be optionally arranged at one or other of the associated machine frames at the ends of the conveyor with the chain direction reversed. To provide for this the stripper device and its mounting arrangement needs to be appropriately symmetrical.

A general object of the present invention is to provide an improved chain stripper device and associated plough box assembly.

SUMMARY OF THE INVENTION

A chain stripper device constructed in accordance with the invention is composed of a one-piece element provided with an arcuate blade for separating a chain from a chain wheel which is supported or clamped to a mounting flange of the plough box with the aid of a locking member with which the element is connected in shape-locking manner. Conveniently, the element and the locking member have one or more interengaging projections and recesses and are disposed at opposite upper and lower surfaces of the mounting flange. Further mating projections and recesses can be provided between the element and the mounting flange and/ or an adjacent structural wall of the plough box. The assembly can be releasably secured with the aid of a single nut-and-bolt extending through aligned upstanding bores in the element, the locking member and the mounting flange.

The element can be provided with an extension which projects away from its arcuate tongue or blade and which locates on the mounting flange in a position opposed to the locking member. This can then provide a symmetrical construction permitting the element to be inverted and used either above or below the mounting flange. By providing appropriate mounting flanges on both sides of the chain wheel the stripper device can be located in two further alternative positions to cope with use at a main or auxiliary drive station. The locking member is small in relation to the main one-piece element and this permits the locking member to be easily inserted into and withdrawn from the plough box thereby to facilitate the fitting and dismantling operations.

The stripper device and assembly is particularly compact and robust. The device can be easily dismantled and assembled even in the narrow plough box. The single bolt need not take up operational forces since these are transmitted through the shape-locking components to the plough box itself.

The projection(s) and recess(es) between the main element and the smaller locking member can inhibit horizontal displacement of the main element while the remaining projections and recesses between the main element and the mounting flange and wall of the plough box inhibit vertical displacement. Conveniently, the mounting flange has a recess at its end facing the chain wheel and this recess, which receives a projection of the main element, is disposed on a central longitudinal plane of the plough box aligned with the centre of the chain wheel. The extension of the main element may have a projection which engages optionally in one of two recesses symmetrically arranged in relation to the aforesaid plane in, for example, a transverse wall of the plough box adjoining the flange.

The side faces of the main element may have threaded bores therein permitting a filler piece to be attached thereto to close off any gap between the element and the inside of the plough box side walls. This is especially useful where chain wheels of smaller dimensions are utilized and where there would otherwise be some danger that the chain could become untensioned and jam itself between the main element and one of the plough box side walls.

The invention may be understood more readily, and various other features of the invention may become apparent, from consideration of the following description.

BRIEF DESCRIPTION OF DRAWINGS

An embodiment of the invention will now be described, by way of example only, with reference to the accompanying drawings, wherein.

DESCRIPTION OF PREFERRED EMBODIMENT

Figure 1:
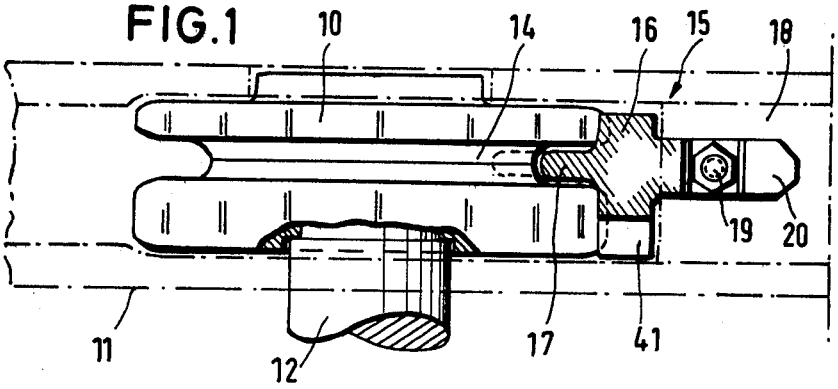
FIG. 1 is a diagrammatic part-sectional plan view of an assembly constructed in accordance with the invention.
Figure 2:
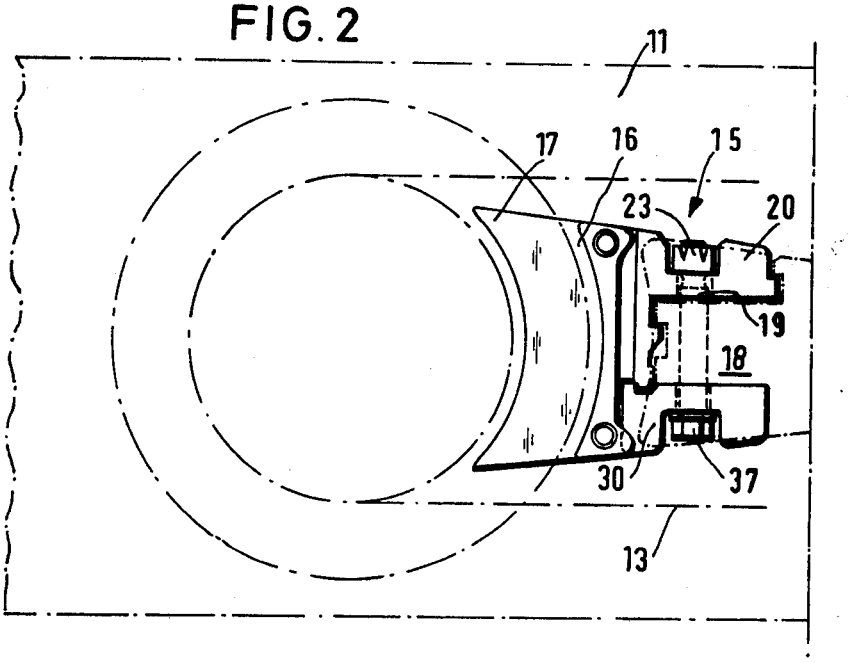
FIG. 2 is a diagrammatic side view of the assembly shown in FIG. 1.

In FIGS. 1 and 2 of the accompanying drawings, a sprocket or chain wheel 10 is disposed within a housing forming the so-called plough box represented schematically by chain-dotted lines 11. The plough box 11 may be constructed as described in U.S. Pat. No. 3,871,513. The plough box 11 itself is fitted by means of a flanged connection to the side of machine frame for a scraper-chain conveyor as is known per se. The chain wheel 10 serves to propel the drive chain of a mineral winning machine, such as a plough, guided for movement back and forth along the conveyor. The wheel 10 is carried on a driven shaft 12 which extends through an opening in the inner side wall of the plough box 11.

As is known per se, the chain wheel 10 has a peripheral shape corresponding to that of the oval links of the chain represented schematically in FIG. 2 by chain-dotted lines 13.

A chain stripper device 15 is mounted in the plough box 11. The device 15 employs a one-piece element 16 formed with an arcuate blade 17 which extends into the groove 14 of the chain wheel 10 in order to separate the chain 13 from the wheel 10 in known manner.

Figure 3:
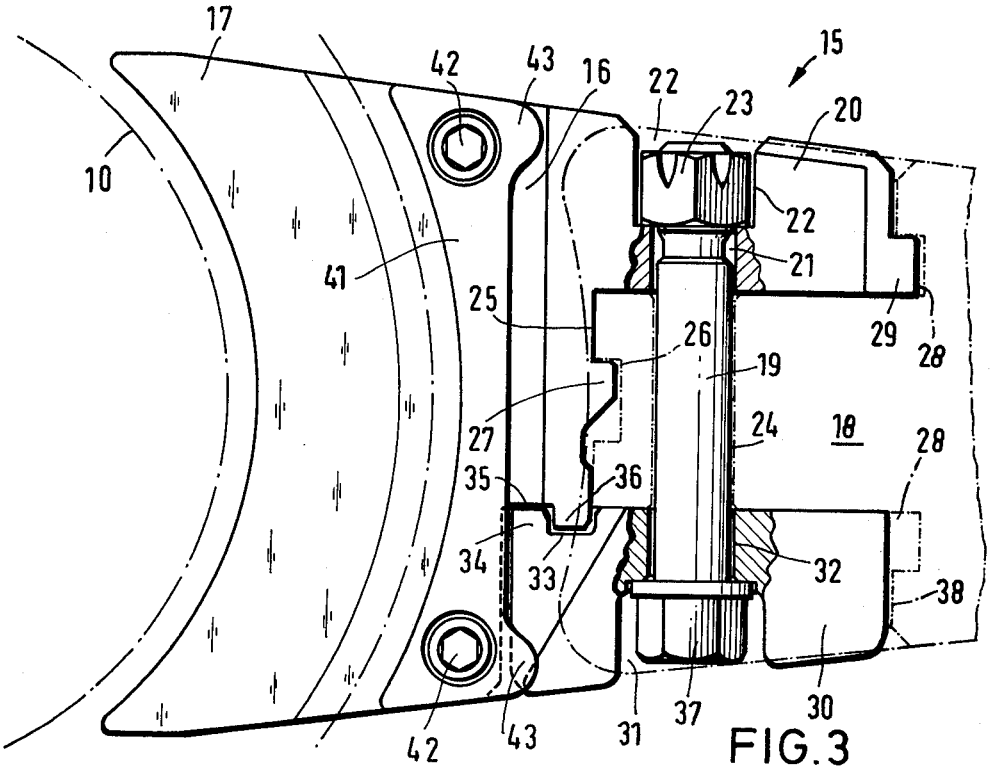
FIG. 3 is a diagrammatic part-sectional side view of the stripper device used in the assembly shown in FIGS. 1 and 2, the view being taken on a somewhat larger scale to that adopted in FIGS. 1 and 2.
Figure 4:
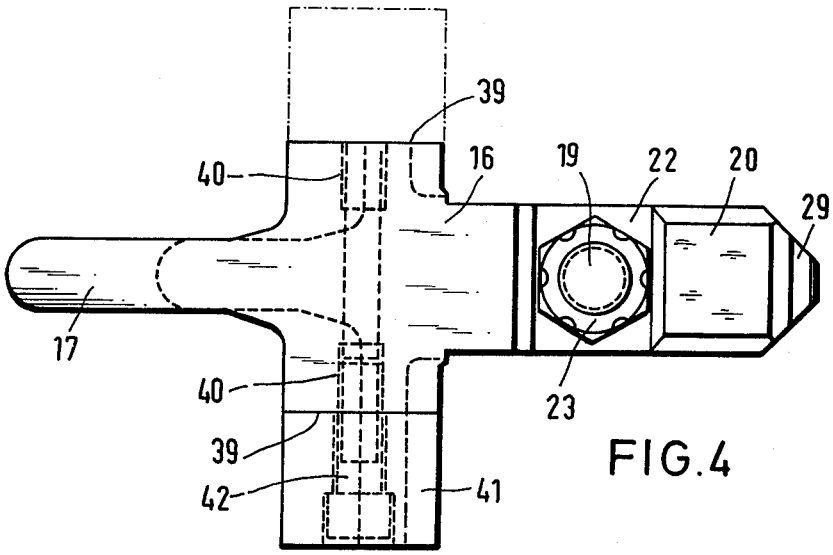
FIG. 4 is a plan view of the stripper device shown in FIG. 3.

The element 16 is detachably secured to a flange 18 of a wall extending transversally of the plough box 11. As shown in FIGS. 3 and 4, the flange 18 has a central horizontal plane passing through the centre of the chain wheel 10. The element 16 is provided with an integral extension 20 which projects over the upper surface of the flange 18. The extension 20 is provided with a recess 22 in its upper surface which communicates with a vertical bore 21. This bore 21 aligns with a corresponding bore 24 in the flange 18 and receives the shank of a bolt 19 used to secure the element 16 to the flange 18. A nut 23 engages on the threaded end region of the bolt 19 and is received in the recess 22. A central recess 26 is provided in the front end face 25 of the flange 18 facing the chain wheel 10 and this recess 26 receives a projection 27 formed on the element 16 beneath the extension 20.

As shown in FIG. 3 the rear portion of the flange 18 remote from the chain wheel 10 adjoins an integral wall, which forms a structural part of the plough box 11. The wall is of increased thickness relative to the flange 18.

The resultant upper and lower shoulders 38 between the flange 18 and the wall are provided with recesses 28. The extension 20 has a projection 29 which engages in the upper recess 28. The provision of the interengaging recesses and projections 26, 27 and 28, 29 acts to locate the element 16 positively with respect to the mounting flange 18 and resists tilting or vertical motion, e.g. lifting of the element 16.

A separate locking member or piece 30 locates beneath the flange 18. The locking piece 30 has a rear face which engages on the shoulder 38 between the wall and the flange 18. The locking piece 30 has a recess 31 which communicates with a bore 32 aligned with the bore 24 in the flange 18. The recess 31 receives the head 27 of the bolt 19. The locking piece 30 is also provided with a stepped portion on its upper face remote from the recess 31 forming a recess 33 and a projection 34. The element 16 has a similarly shaped region providing a projection 36 and a recess 35. The interengagement between the respective projections and recesses 34, 35 and 33, 36 connects the locking piece 30 and the element 16 and resists horizontal movement of the element 16.

The stripper device 15 and the overall assembly as described is able to be used with various chain wheels 10 and in some applications an additional component in the form of a filler piece 41 shown in the drawings can be fitted as described hereinafter. When the stripper device 15 is to be installed the locking piece 30 is assembled to the bolt 19 and these components are then fitted to the underside of the flange 18 so that the bolt 19 projects partly into the bore 24.

The element 16 is then placed in position onto the flange 18 and adjustment is made to engage the projections 27, 29 in the recesses 26, 28 and to align the bore 21 with the bores 24, 32. The bolt 19 is then pushed upwardly until the nut 23 can be engaged and tightened. Although the bolt 19 and its nut 23 secure the components of the assembly together, forces which are applied to the stripper device 15 during use are taken up by the shape-locking arrangement represented by the interengaging projections and recesses and transmitted to the plough box 11. In order to dismantle the stripper device 15, the nut 23 is simply removed, thus, permitting the removal of the element 16, the bolt 19 and the locking piece 30.

The provision of the two recesses 28, as described or otherwise, and the symmetrical nature of the arrangement permits the element 16 to be inverted and installed above or below the flange 18. By providing a similar flange and transverse wall structure at the other side of the chain wheel 10, i.e. at the left-hand side of FIGS. 1 and 2, the stripper device 15 can be optionally positioned at one or other side of the chain wheel 10 depending on the direction of the chain 13.

As shown in FIGS. 1 and 4, the element 16 is offset laterally from the centre of the plough box 11 to engage in the groove 14. This means there is a gap of greater width between one side 39 of the element 16 and the inner face of the adjacent side wall of the plough box 11. A filler piece 41 is detachably secured to the element 16 to compensate for this gap. More particularly, both sides of the element 16 are provided with threaded bores 40 so that the filler piece 41 can be secured to one or other side of the element 16 with the aid of screws 42. This is of particular benefit where chain wheels of smaller size are employed since the filler piece 41 can reliably prevent jamming of the chain in the gap between the element 16 and the more distant plough box side wall. As shown in FIG. 3, the filler piece 41 is provided with bead-like protruberances 43 which are symmetrical relative to the central longitudinal plane through the plough box 11. This enables the filler piece 41 to be inverted and used at either side of the element 16. The protruberances 43 assist in guiding the chain and preventing jamming. Where chain wheels of greater size are employed, the filler piece 41 can be removed.

We claim:

1. In or for a mineral mining machine frame assembly employing a chain wheel disposed in a plough box at one side of the assembly and a chain stripper device detachably supported on a mounting flange extending across the plough box, wherein said device comprises a one-piece element provided with a blade for separating a chain from the chain wheel, the element having a projection opposite the blade which engages on a first face of the flange, a complementary locking member which makes a shape-locked connection with the element, the locking member engaging on a lower face of the flange, and a threaded connector extending through alignable bores in the projection of the element, the flange and the locking member.

2. A device according to claim 1, wherein the element and the locking member are provided with at least one interengageable projection and recess effecting said shape-locking connection.

3. A device according to claim 2, wherein said at least one interengageable projection and recess between the element and the locking member inhibits horizontal displacement of the element.

4. A device according to claim 3, wherein at least one further interengageable projection and recess is provided between the element and the mounting flange and said further projection and recess inhibits vertical displacement of the element.

5. A device according to claim 1, wherein the threaded connector is a single nut-and-bolt.

6. A device according to claim 4, wherein the at least one further interengageable projection and recess is disposed on a central longitudinal horizontal plane extending through the plough box and containing the mounting flange and a rotational axis of the chain wheel.

7. A device according to claim 1, wherein the element and the locking member can be positionally inverted in relation to the mounting flange.

8. A device according to claim 5, wherein the projection of the element and the locking member have recesses for accommodating a head of the bolt and the nut associated therewith.

9. A device according to claim 4, wherein another inter-engageable projection and recess is provided between the end of the projection of the element and a wall of the plough box adjoining said flange.

10. A device according to claim 1, wherein further shape-locking connection is established between the mounting flange and the element.

11. A device according to claim 6, wherein the projection of the element has a shouldered end region remote from the chain wheel, the shoulder of the end region being receivable in one of the two recesses provided in a wall of the plough box adjacent the mounting flange, the recesses in said wall being disposed in symmetrical relationship relative to said central plane.

12. A device according to claim 1, wherein the element has side faces provided with threaded bores and a separate filler piece is securable with screws to one or other of the side faces to close the gap between an element and an interior wall of the plough box.

* * * * *